United States Patent [19]

Chulay et al.

[11] 4,304,356

[45] Dec. 8, 1981

[54] SUPPORTING CAP FOR SEALED CENTRIFUGE TUBE

[75] Inventors: Steven J. Chulay, Los Altos; Steven T. Nielsen, Sunnyvale, both of Calif.

[73] Assignee: Beckman Instruments, Inc., Fullerton, Calif.

[21] Appl. No.: 122,324

[22] Filed: Feb. 19, 1980

[51] Int. Cl.[3] ..... B04B 15/00

[52] U.S. Cl. ..... 233/26; 366/213

[58] Field of Search ..... 233/26, 1 A, 1 R, 1 B; 366/213, 218

[56] References Cited

U.S. PATENT DOCUMENTS

| | | | |
|---|---|---|---|
| 3,720,502 | 3/1973 | Gropper | 233/26 |
| 3,938,735 | 2/1976 | Wright | 233/26 |
| 3,998,383 | 12/1976 | Romanauskas | 233/26 |
| 4,015,775 | 4/1977 | Rohde | 233/26 |
| 4,076,170 | 2/1978 | Chulay | 233/26 |
| 4,080,175 | 3/1978 | Chulay | 233/26 |
| 4,154,690 | 5/1979 | Ballies | 233/26 |
| 4,166,573 | 9/1979 | Webster | 233/26 |

FOREIGN PATENT DOCUMENTS

| | | | |
|---|---|---|---|
| 2,922,208 | 12/1979 | Netherlands | 233/26 |

*Primary Examiner*—Robert W. Jenkins

*Attorney, Agent, or Firm*—R. J. Steinmeyer; F. L. Mehlhoff; William H. May

[57] ABSTRACT

A fluid-containing means for each bore of a centrifuge rotor is disclosed which combines a self-capped tube and a floating cap resting on the top of the tube and arranged to resist deformation of the tube by the centrifugal forces developed therein. The floating cap has an annular skirt which engages the top of the tube and which is sufficiently thick in cross-section to prevent deformation of the floating cap. The floating cap is formed from a relatively light plastic, having a density less than that of the centrifuged fluid, thereby preventing bottoming of the floating cap in the bore in the event of rupture of the tube.

14 Claims, 3 Drawing Figures

SUPPORTING CAP FOR SEALED CENTRIFUGE TUBE

BACKGROUND OF THE INVENTION

This invention relates to the centrifuge field, and particularly to the sample retaining means used in the bores, or cavities, of a centrifuge rotor.

The advantages of the present invention are primarily intended for use in centrifuge rotors having bores which are inclined with respect to the vertical rotational axis, so that the centrifugal force has a component urging the sample toward the bottom of the bore. However, the invention may also be useful in conjunction with centrifuge rotors having vertical sample-containing bores.

Furthermore, the present invention appears to have its primary advantages in conjunction with the use of "Quick Seal" sample-containing tubes, which are tubes having their cover areas formed integrally with their bodies, and sealed by fusion of a nipple, or neck, after it has been used for insertion of the fluid sample. Such tubes have proved to be highly advantageous, as compared with earlier open top tubes, which had to be sealed with separate caps and which therefore had serious sealing problems.

The invention of "Quick Seal" tubes is disclosed in Nielsen Application Ser. No. 912,698, titled "An Integral One Piece Centrifuge Tube", filed on June 5, 1978, and assigned to the assignee of the present application.

Since Quick Seal tubes are thin-walled vessels in which the cover portion is integral with the body portion, the forces developed by centrifuge operation have a tendency to deform the upper portion of the tube. Such forces are due both to the hydraulic pressures inside the tube which act on the tube during centrifugation, and to the "buckling" effect on the inner, or centripetal, portion of the tube if significant amounts of air are enclosed in the tube, either entrained in the liquid material or left in the tube because the liquid does not fill it.

In order to prevent deformation of Quick Seal tubes, certain precautions must be taken, particularly in providing support for the upper surface of the tube. In bores which are obliquely oriented with respect to the rotor axis, an ideal arrangement comprises a floating supporting cap engaging the top of the tube, even though such a cap is not required for closing, or sealing, the tube. The particular advantage of a floating cap is that centrifugal force will thrust it against the tube top, so that its pressure on the tube top will tend to prevent deformation of the tube. Because such a cap is floating it will firmly engage the top of the tube regardless of the distance between the tube top and the upper end of the rotor cavity, or bore, which contains the tube.

As shown in FIG. 12 of Nielsen Application Ser. No. 912,698, a floating cap, or plug, may lie on top of the tube in the obliquely-oriented cavity, relying on centrifugal force to maintain the cap, or plug, in engagement with the tube, and thus to provide support for the tube during centrifugation. A very significant advantage of floating caps used in inclined bores is that the counterbore can be completely eliminated. This will make possible rotors with higher performance and/or greater tube volume because of improved stress conditions near the upper portion of the rotor.

As the full significance of the tube-supporting function of the floating cap has been more fully recognized, and as performance tests have been made on the combination of Quick-Seal tubes with such floating caps, structural problems have been encountered and analyzed relating to the shape of the floating cap shown in FIG. 12 of the Nielsen application. Specifically, it has become apparent that the floating cap must be so designed as to be structurally self-sufficient in avoiding permanent deformation by the powerful centrifugal and hydraulic forces generated in the centrifuge.

The tube supporting function of the cap has involved extreme stressed on the floating caps, which have caused them to deform into substantially oval or elliptical shapes, and to take a set in the deformed shapes, rendering the caps difficult to extract from the rotor cavities, and useless for subsequent centrifuge operations.

Another aspect of floating caps which has been the subject of significant improvement since disclosure of the concept in the Nielsen Application is the selection of material for such caps, particularly with reference to its density. In the event of failure of a tube, it is desirable that the position shift of the cap be minimized in order to avoid rotor imbalance during centrifugation. Also the cap material should not be such as to score the walls of the tube cavity.

In general, the present invention is intended to solve the structural deformation and related problems encountered in using the combinations of Quick Seal tubes with floating caps, which are particularly useful in conjunction with centrifuge rotors having obliquely-oriented sample-containing bores.

SUMMARY OF THE INVENTION

The present invention combines a floating cap so shaped as to provide adequate resistance to the deforming forces exerted on it, with a self-capped tube having an upper surface substantially conforming to the engaging surface of the floating cap. Whereas, in the structure of FIG. 12 of the Nielsen application, the most convenient form of the tube was used, and the shape of the cap was dictated by the tube, in the present application the essential structural requirements of the cap, necessary to avoid its deformation, are first determined, and the tube is altered to conform thereto.

In order to retain the essentially spherical shape of the upper portion of the tube, which is desirable both from a functional and from a manufacturing standpoint, the center portion of the tube upper surface is essentially dome-shaped, and the floating cap has in its lower surface a concave recess which engages and substantially conforms to the dome-shaped surface of the tube. The cap has an annular axially-extending peripheral portion which resists deformation of the cap and provides an annular end surface against which the peripheral area of the tube is pressed during centrifugation.

The density of the cap and its mass are preferably such that a substantial portion of the fluid sample has a higher density than the cap material, although the effective weight of the cap during centrifugation must be sufficient to withstand the axially-oriented hydraulic forces tending to burst, or rupture, the tube.

DETAILED DESCRIPTION OF THE PREFERRED EMBODIMENT

Figure 1:
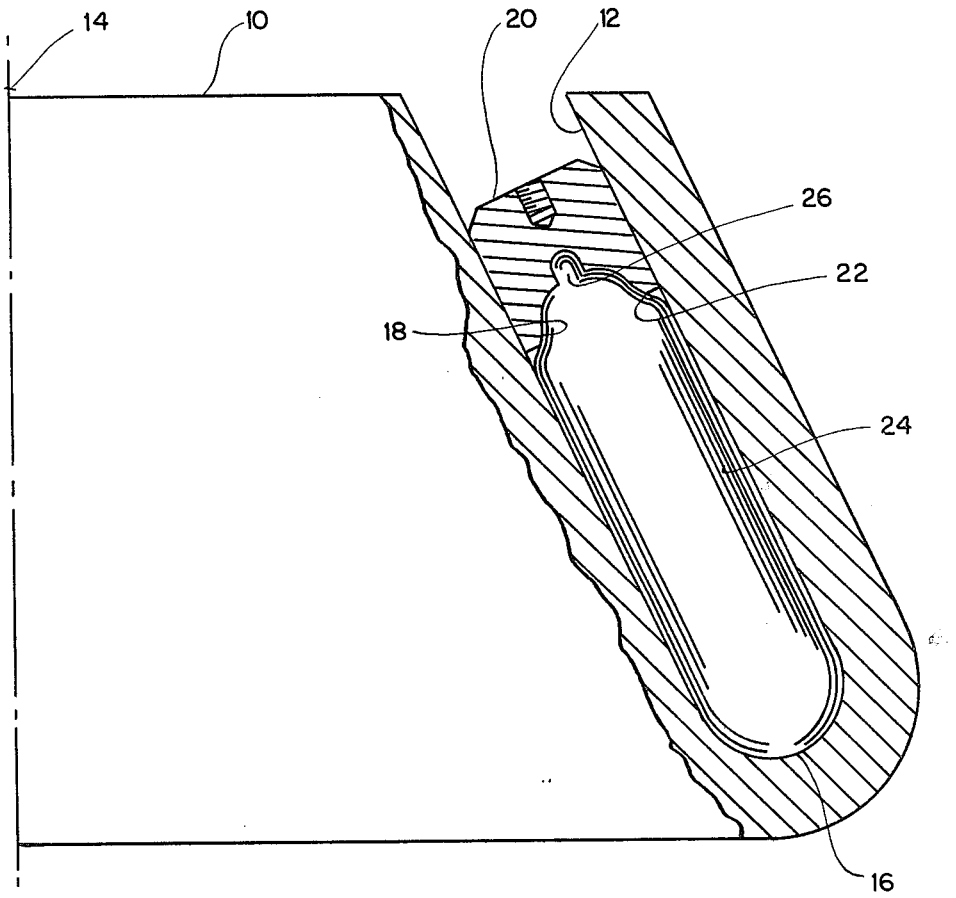
FIG. 1 is a schematic partial sectional view of a centrifuge rotor having each tube-containing cavity at an angle oblique to the spin axis.

As shown in FIG. 1, a centrifuge rotor 10 has a plurality of circumferentially spaced bores, or cavities, 12 each adapted to retain a fluid sample during centrifugation. The bores 12 are at an oblique angle with respect to the spin axis 14 of the rotor. With this arrangement, the horizontally acting centrifugal force has components acting both laterally and axially in each bore 12, with the axial force component urging the sample toward the bottom, or outer, end 16 of the bore.

Inserted in bore 12 are a sample-containing tube 18 and a floating cap 20 engaging the top of the tube. The cap is free to move along the bore 12 except for the resistance of the tube and the frictional contact between the cap and the bore.

The tube 18 is a Quick Seal tube, of the type disclosed and explained in detail in Nielsen Application Ser. No. 912,698. Its cover, or top, portion 22 (see FIG. 2) is formed integrally with its body portion 24 by a suitable process, such as blow molding. In the center of the top portion 22 of the tube is a projection, or nipple, 26 formed initially as a tube-like extension through which the fluid sample is inserted into the tube, and then hermetically sealed by a suitable process, such as heat fusion.

In the structure disclosed in most of the embodiments of the Nielsen Application, both the lower and upper ends of the tube are spherically shaped. There is an inherent advantage in this spherical shape because it provides the least resistance to gradient reorienting during centrifugation. In other words, the spherical shape causes minimum changes in the cross-sectional area encountered by the reorienting fluid in the tube. Abrupt changes in the cross-section tend to interfere with smooth reorientation. It is also necessary that any air bubbles in the sealed tube migrate toward the low pressure side of the tube (i.e., the side nearest the spin axis); and any abrupt changes in the contour of the top of the tube might cause air to be trapped in the sample.

The term "gradient" in the preceding paragraph refers to the bulk of the liquid usually contained in a centrifuge tube. In the parlance of the field, the "sample" may be a small portion of the tube-enclosed material, such as a biological sample on the top of the enclosed liquid. As used in this application, including the claims, the term "sample" generally refers to the entire amount of fluid material placed in the tube for centrifugation.

In the present application, the upper surface 22 of tube 18 is so shaped as to cooperate with the particular structure of the cap 20. The body portion 24 of the tube is cylindrical to conform to the shape of bore 12, and the lower end of the tube and bore may be hemispherical, as shown in FIG. 1. The center portion 28 of the top 22 of the tube is substantially spherically formed, for the reasons discussed above, and thus provides what may be described as a dome-shaped configuration, at the top and axial center of which is the nipple extension 26. Below the central dome-like portion 28 the integral cover 22 of the tube is first curved convexly at 30 (as seen from inside the tube) and then concavely at 32, where it joins the cylindrical surface of the body 24 of the tube. For reasons already explained, it is important not to have abrupt changes in the contour of the tube upper surface, along which the sample gradient moves during centrifugation.

The cap 20 has a concave recess 34 in its lower surface which engages and substantially conforms to the dome-shaped center area 28 of the tube upper surface. At the center of recess 34 is an axially extending hole 29 which accommodates the nipple 26. At the center of the upper side of the cap, a threaded hole 31 may be provided to permit insertion of a cap extraction tool.

In providing a practical design, it may be preferred to form the center portion 28 of the tube top on a radius substantially longer than the radius of the bore 12, thereby somewhat reducing the overall vertical dimension of the tube, and permitting less depth in the concave recess in the cap. In such a configuration, which is the one shown herein, the concave (as seen from inside the tube) center of the tube top is formed on a longer radius and merges with a continuing concave portion formed on a shorter radius before reaching the convexly shaped portion 30.

The outer peripheral portion of the cap, instead of continuing the generally spherical contour of the cap's center portion outwardly to the wall of the bore, is an annular axially extending portion, or skirt, 36 which extends downwardly in the cavity and terminates in a substantially flat annular surface 38. The peripheral portion of the tube, as shown, does not rest against the surface 38 initially, leaving an annular gap 40. However, during centrifugation the hydraulic pressures in the tube will press the tube against surface 38, to form a corner where the cover of the tube joins its cylindrical outer surface.

In Nielsen Application Ser. No. 912,689, the outer edge of the floating cap is "feathered", i.e., it is extremely thin because of its conformity to the spherical cover of the tube. Not only does this configuration permit deformation of the cap during centrifugation (usually into an oval or elliptical shape), but also the cap tends to take a set, i.e., to remain deformed after completion of centrifugation. When it does remain deformed, the cap is useless for subsequent centrifuge operations, and it also causes serious difficulties in removing the cap (and therefore the tube) from the bore.

The cap configuration of the present invention is so designed as to provide sufficient cross-sectional area in the axial extension 36 of the cap to prevent permanent deformation of the cap during centrifugation. This necessitates changing (in the manner disclosed herein) the top of the tube which conforms to the inner end of the cap, except that the tube contours are so curved as to avoid any sharp changes in the shape encountered by the gradient as it moves during centrifugation.

Figure 2:
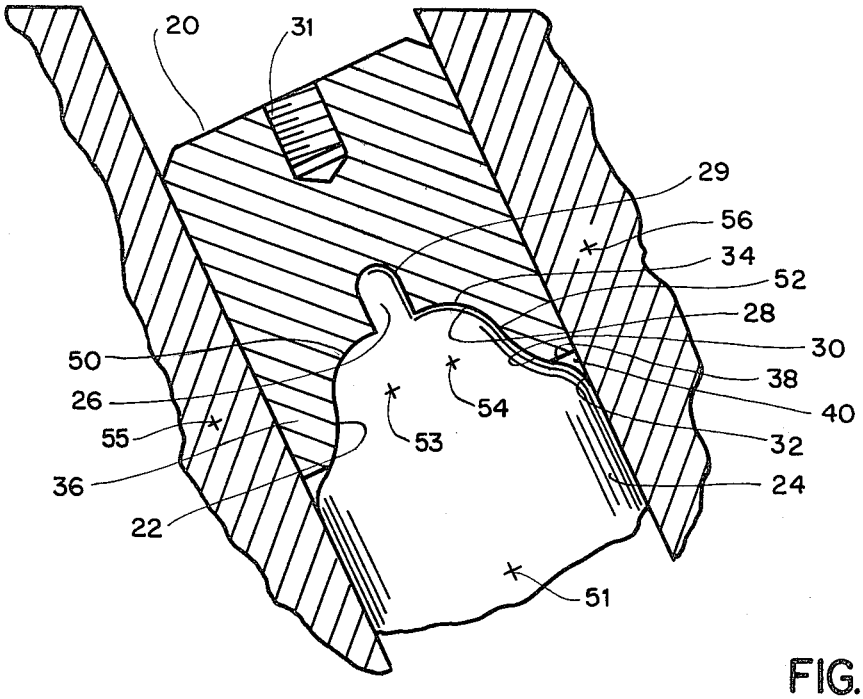
FIG. 2 is a closeup of the upper portion of the tube and floating cap of FIG. 1.

The particular configuration of the lower tube-engaging surface of the cap 20 can be varied substantially without departing from the primary concepts of the present invention. However, the details of the currently preferred shape are as shown in FIG. 2. As seen in cross-section, the spherical center portion 50 of the cap's lower surface is formed as an arc on a radius centered at 51. The annular portion 52 of the cap's lower surface adjoining center portion 50 is formed on arcs having much shorter radii centered at 53 and 54. At the outer edge of the arcuate surface 52, it is convenient to reverse the shape of the curve by forming an arcuate portion on a radius centered on the other side of the formed surface from the centers of the radii described previously. Thus, the annular portion 30 of the cap's lower surface near the periphery thereof is formed on arcs having radii centered at 55 and 56; and these arcs extend to the inner edge of the flat annular surface 38.

Determining the material from which to form cap 20 is an important consideration. Plastic material is preferred to metal, for a number of reasons, one of which is to avoid the problems of scoring the surface of bore 12 by a metal cap moving in the bore. In other words, a material is needed which is sufficiently strong to prevent deformation of the cap, but which is compliant enough not to score the rotor bore.

Because the cap 20 is floating, a new potential problem is introduced which was not present in earlier cap designs wherein the cap was supported by the land of a counterbore. If the tube should rupture, the liquid sample and the cap are free to reorient themselves in the bore. In other words, if the cap were sufficiently heavy it would be caused by centrifugal force to move down the bore toward the outer edge of the rotor. This would cause a rotor imbalance which might create serious problems.

It has been determined experimentally that a desirable cap-forming material is the plastic "Noryl", a polyphenylene oxide-based thermoplastic which meets the requirement of adequate strength while avoiding scoring. It also has the significant advantage of a relatively low density of approximately 1.05 grams/-milliliter. Since this density is less than that of fluids generally centrifuged in rotors of this type, tube failure will not cause the cap to centrifuge to the bottom of the bore. While some of the constituents of the liquid in the tube may have a lower density than the cap, if a substantial portion of the liquid has a higher density than the cap, the risk of rotor imbalance will be significantly reduced. Moreover, since rotors are normally rated for fluid load densities of 1.2 grams/milliliter or greater, speed deration of rotors will not be necessary when spacers are used having the relatively low densities discussed above. Although the specific material discussed, Noryl, has proved highly satisfactory, it is, of course, feasible to substitute any other material which meets the general requirements outlined herein.

In addition to density considerations relative to the cap-forming material, there are mass requirements for the cap. It must have sufficient effective weight during centrifugation to resist the hydraulic pressures which act upwardly inside the tube, tending to rupture it. The forces resisting this upward hydraulic pressure on the cap are the effective weight of the cap caused by centrifugation, plus the frictional forces between the cap and the bore due to the laterally oriented pressure components. The frictional force may constitute a very significant portion of the total resistance provided by the cap. For example, experiments suggest that, for a bore oriented at approximately a 20° angle from the vertical, the effective weight of the cap and the friction may be substantially equal (i.e., 50% and 50%) components of the resisting force. In other words, a cap having an effective weight along the tube axis equal to approximately one-half of the resultant hydraulic force in the opposite direction, will remain in position in a rotor having a tube angle of 20° or more from the vertical. The availability of the frictional "assist" in resisting the hydraulic pressures provides an important design benefit. Because rotor design must be affected by the weight of the material in the bores, any considerations which permit reduction of such weight are valuable. Because of the friction utilization, lighter caps can be used, thereby permitting higher speeds or more tube cavities, because the upper portion of the rotor, which often is the critical stress region, will not be so heavily loaded.

Figure 3:
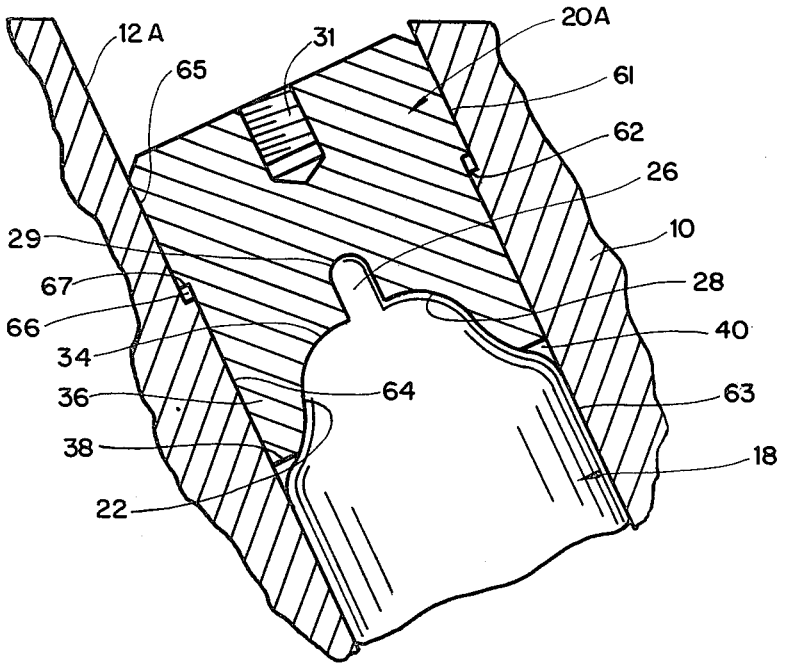
FIG. 3 is a closeup of a tube and cap combination mounted in a tube-containing cavity having a counterbore.

FIG. 3 discloses a floating cap designed for use in a rotor bore having a counterbore portion at its top. Such counterbored rotors are currently in widespread use, and it may therefore be desirable to provide floating caps which could be used with such counterbores. As shown in FIG. 3, the rotor bore 12A has an upper counterbored portion 61 terminating in a land 62 at the upper end of the bore 63 which receives tube 18. The lower portion 64 of floating cap 20A fits the bore 63, and the upper portion 65 of floating cap 20A has a slightly larger diameter which fits the counterbore 61. A gap 66 is left between land 62 on the bore 12A and land 67 on the floating cap 20A, thereby insuring that the cap 20A will "float" in the bore to maintain supporting engagement with the top of tube 18. Other numerals used in FIG. 3 are the same as those used in FIGS. 1 and 2 to indicate the same structural features.

The following claims are intended not only to cover the specific embodiments disclosed, but also to cover the inventive concepts explained herein with the maximum breadth and comprehensiveness permitted by the prior art.

What is claimed is:

1. In a centrifuge rotor having at least one cylindrical bore for receipt of a fluid sample, sample retaining means comprising:

a closed tube containing the sample and having a cylindrical body portion which generally conforms to the shape of the bore and an upper surface which has a generally dome-shaped center area;

a cap extending into the bore to engage the top of the tube and having in the center of its lower surface a concave recess which engages and substantially conforms to the dome-shaped center area of the tube upper surface;

the cap having an annular axially extending peripheral portion which encircles the dome-shaped area of the tube and which has sufficient cross-sectional area to prevent permanent deformation of the cap during centrifugation, said axially extending peripheral portion terminating in a substantially flat annular surface adjacent the tube; and the upper surface of the tube having a peripheral area around the dome-shaped center area, which peripheral area during centrifuge operation is pressed against the adjacent annular surface of the peripheral portion of the cap.

2. The structure of claim 1 wherein the cylindrical bore in the rotor is at an angle such that centrifugal force tends to move the tube to the bottom of the bore.

3. The structure of claim 2 wherein the cap is a floating member resting on the tube and free, except for the tube, to move toward the bottom of the cavity under the effect of centrifugal force.

4. The structure of any of claims 1, 2 or 3 wherein the cap is formed of material having a lower density than that of the fluid sample.

5. The structure of any of claims 1, 2 or 3 wherein the tube is so formed that its body portion and its upper closing portion are integrally formed from the same material, which has been fused to seal the tube after insertion of the fluid sample.

6. The structure of claim 5 wherein the tube upper portion has a nipple at its center, and the center of the cap has an axial hole into which the nipple extends.

7. The structure of claim 4 wherein the bore containing the tube and floating cap is at an angle to the vertical such that the hydraulic pressures tending to burst the top of the tube are resisted in significant proportion both by the centrifugally induced effective weight of the cap and by the frictional forces between the cap and the wall of the bore.

8. The structure of claim 2 or claim 3 wherein the bore containing the tube and floating cap is at an angle to the vertical such that the hydraulic pressures tending to burst the top of the tube are resisted in significant proportion both by the centrifugally induced effective weight of the cap and by the frictional forces between the cap and the wall of the bore.

9. The structure of claim 1 wherein the peripheral area of the upper surface of the tube, which encircles its dome-shaped outer area, is shaped to generally follow the corresponding portion of the cap, but has first a convexly curved shape adjacent the dome-shaped center portion and then a concavely curved shape adjacent the cylindrical body portion, thereby minimizing changes in the cross-sectional area encountered by reorienting fluid.

10. In a centrifuge rotor having at least one cavity for receipt of a fluid sample, sample retaining means comprising:

a closed tube containing the sample and having a body portion which generally conforms to the shape of the cavity and an upper surface which seals in the fluid sample;

a floating cap extending into the cavity to engage the top of the tube and arranged to substantially conform to the shape thereof;

the cavity being at such an angle that centrifugal force tends to move the tube and the cap toward the bottom of the cavity; and the cap being formed of material of a density less than the density of a substantial portion of the fluid in the tube, thereby limiting outward movement of the cap in the event the tube bursts.

11. The structure of claim 10 wherein the cavity containing the tube and floating cap is at an angle to the vertical such that the hydraulic pressures tending to burst the top of the tube are resisted in significant proportion both by the centrifugally induced effective weight of the cap and by the frictional forces between the cap and the wall of the cavity.

12. The structure of claim 10 wherein the floating cap has sufficient mass that its effective weight prevents its upward displacement due to hydraulic pressures exerted in the tube during centrifugation.

13. The structure of claim 10 wherein the floating cap has sufficient effective weight during centrifugation and sufficient frictional engagement with the cavity wall to prevent upward displacement of the cap by the hydraulic pressures developed within the tube.

14. In a centrifuge rotor having at least one cylindrical bore for receipt of a fluid sample, sample retaining means comprising:

a closed tube containing the sample and having a cylindrical body portion which generally conforms to the shape of the bore and an upper surface which has a generally dome-shaped area; and a cap engaging the top of the tube and having in its lower surface a concave recess which engages and substantially conforms to the dome-shaped area of the tube upper surface;

the cap having an annular axially extending skirt which encircles the dome-shaped area of the tube and which has sufficient cross-sectional area to prevent permanent deformation of the cap during centrifugation, said axially extending skirt terminating in a substantially flat annular surface.

* * * * *